United States Patent [19]

Hürzeller et al.

[11] 4,117,283

[45] Sep. 26, 1978

[54] SWIMMING POOL TOUCH PAD CONSTRUCTION

[75] Inventors: Peter Hürzeller, Bellach; Louis Degiez, Neuveville, both of Switzerland

[73] Assignee: Societe Suisse pour l'Industrie Horlogere Management Services, S.A., Bienne, Switzerland

[21] Appl. No.: 732,256

[22] Filed: Oct. 14, 1976

[51] Int. Cl.[2] ..... H01H 35/00

[52] U.S. Cl. ..... 200/52 R; 200/86 R; 272/4

[58] Field of Search ..... 200/52 R, 85 R, 86 R; 272/4; 206/328

[56] References Cited

U.S. PATENT DOCUMENTS

| | | | |
|---|---|---|---|
| 3,584,169 | 6/1971 | Len | 272/4 X |
| 3,590,181 | 6/1971 | Baran | 200/52 R |
| 3,676,696 | 7/1972 | Len et al. | 272/4 X |
| 3,737,031 | 6/1973 | Carroll | 206/328 X |
| 3,745,275 | 7/1973 | Degiez | 272/4 X |
| 3,784,768 | 1/1974 | Hunt | 272/4 X |
| 3,916,214 | 10/1975 | Coble et al. | 272/4 X |
| 3,920,940 | 11/1975 | Brown et al. | 272/4 X |

FOREIGN PATENT DOCUMENTS

| | | | |
|---|---|---|---|
| 572,250 | 1/1976 | Switzerland | 272/4 |

*Primary Examiner*—James R. Scott
*Attorney, Agent, or Firm*—Griffin, Branigan and Butler

[57] ABSTRACT

A touch pad as used in swimming pools for timing competitions has instead of an integrally formed striker plate or one comprising independently mounted panels, a plurality of hollow extruded plastic panels each with a hook portion on one edge and a hook receiving portion on the other edge whereby said panels may be readily assembled to form the striker plate.

4 Claims, 5 Drawing Figures

SWIMMING POOL TOUCH PAD CONSTRUCTION

BACKGROUND OF THE INVENTION

The present invention concerns a touch pad construction such touch pads being used in timing swimming competitions and being arranged to be mounted on one wall of the swimming pool. Basically, such touch pads comprise a striker plate and at least one electric contact cable. When a swimmer comes into contact with the striker plate the motion thereof causes a contact within the cable to be closed thereby providing signals to a suitable measuring apparatus.

Known touch pad constructions include among others an arrangement such as shown for example in U.S. Pat. Nos. 3,590,181 or 3,745,275. In the first of these a series of elongated panels are mounted side by side in a hinged manner along the length of a supporting bar. These panels are thus substantially independent of one another and reaction thereof may tend to be somewhat irregular. Since each such panel, moreover, must be provided with an individual switch the arrangement tends to become quite expensive. In the arrangement as shown in U.S. Pat. No. 3,745,275 the entire touch pad striker plate is made of a single integrally formed panel. To achieve the required rigidity and at the same time retain other desirable characteristics such single integrally formed touch pads were made by the lamination and hot pressing together of three sheets and the assembly was thereafter provided with holes which in such case appear necessary to prevent the wave motion occurring within the swimming pool from accidentally triggering the switching arrangements. Such a construction was both heavy and rather costly.

The present invention has as its purpose to overcome the disadvantages of these and similar prior art constructions through the use of a built-up panel using as base elements a series of identical panels which may be assembled together in a particularly simple manner so as to provide the finished article of any desired size within certain limits. It has been found that the arrangement according to the invention, moreover, provides the necessary rigidity and sensitivity whilst at the same time providing further the advantages of the pierced construction shown in U.S. Pat. No. 3,745,275.

Furthermore, in effect owing to the mounting and assembling arrangement, each individual panel may undergo a slight rotational motion and this has been found to give an improved touch sensitivity. In respect of the assembled arrangement according to the invention one fixed point is at the bottom and this ensures that a very small amount of flexion is sufficient to ensure contact using only two contact sleeves. In the prior art arrangement as many as five sleeves have been necessary.

It is readily evident that the novel arrangement according to the invention will be much lighter than earlier arrangements and owing to this particular construction it has been found that for the same area of surface the price will be about half that of the known constructions.

SUMMARY OF THE INVENTION

The invention accordingly provides a touch pad for swimming competitions adapted to be mounted on the finishing wall of a swimming pool, comprising a striker plate and at least one electric contact cable arranged between said striker plate and said finishing wall, said striker plate formed by a plurality of elongated hollow vertically extending panels, each panel having along one longitudinal edge a hook portion and along the other longitudinal edge an opening adapted to receive and retain the hook portion of an adjacent panel.

DETAILED DESCRIPTION OF THE INVENTION

Figure 1A:
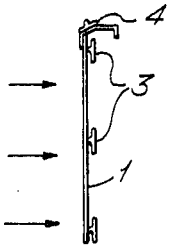
FIGS. 1 and 1*a* show respectively a face view and an end sectional view of a touch pad construction in accordance with one known form of prior art.
Figure 1:
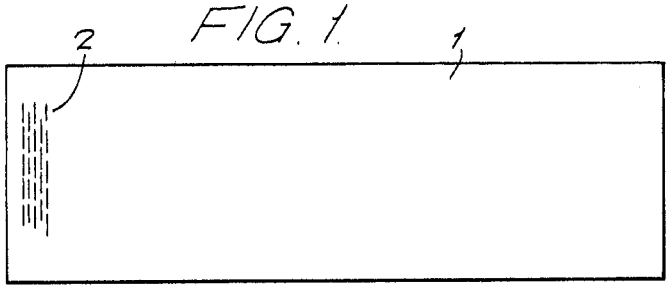
PRIOR ART FIG. 1

FIGS. 1 and 1*a* represent basically the prior art as shown in greater detail for example in U.S. Pat. No. 3,745,275. Herein a solid integrally formed panel 1 provides the striker plate element and is provided with perforations 2 whereby the effect of waves may be substantially attenuated. As shown at 3 in FIG. 1*a* contact cables are placed between the striker plate and a finishing wall of the swimming pool whereby contact with the plate will cause an electrical circuit to be completed by means of the one or more contact cables shown. For further details reference should be made to the above-mentioned U.S. patent.

Figure 2A:
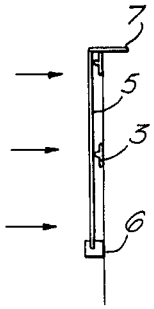
PRIOR ART FIG. 2A
FIGS. 2 and 2*a* show respectively face and end cross sectional views of a touch pad arrangement formed of elements in accordance with the invention.
Figure 2:
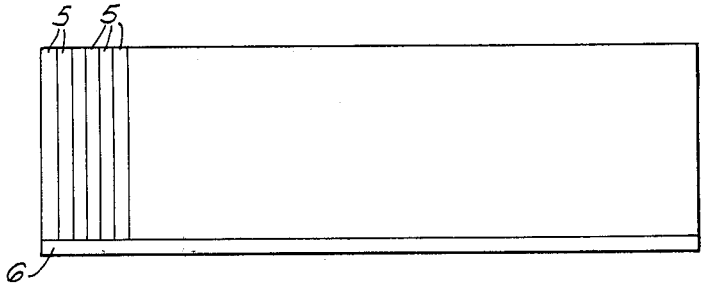

In FIGS. 2 and 2*a* an assembled touch pad in accordance with the invention is shown. Herein a plurality of elongated vertically extending panels are assembled side by side and are retained at the bottom ends thereof by a support bar 6. At the top there is provided a flexible upper retaining strip as shown at 7 in FIG. 2*a* and in greater detail in FIG. 4.

Figure 3:
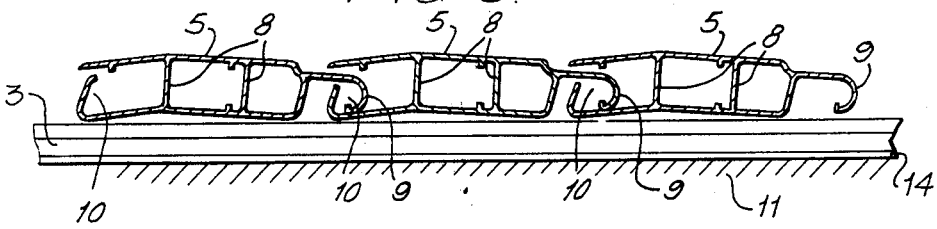
FIG. 3 is a top sectional view taken along the line 3—3 of FIG. 4 and showing three of the novel panels according to the invention as they would appear when assembled together.

Turning now to FIG. 3 there may be readily seen the novel construction of the panels which, when assembled, form the completed striker plate of the touch pad of this invention. Each panel comprises an elongated hollow extruded box-like formation 5 in which there are provided as shown at 8 reinforcing walls extending across the thickness. Along one longitudinal edge of each such panel is provided a hook portion 9 which may be formed at the same time as the rest of the panel is being formed by the extrusion process. Thus manufacture provides no particular problem. Along the opposite edge there is provided an opening means 10 which is so formed as to be capable of receiving and retaining the hook portion of an immediately adjacent panel. The entire panel structure as may be easily appreciated by those skilled in the art may readily be obtained by a simple extrusion process and preferably is obtained in a plastics material as for instance.

Thus to obtain the completed striker plate it is merely necessary to hook together as many panels as are required to achieve the desired touch pad length. Thereafter, the remaining components which go to make up a completed touch pad are placed in the assembly and the entire arrangement is ready for use.

Figure 4:
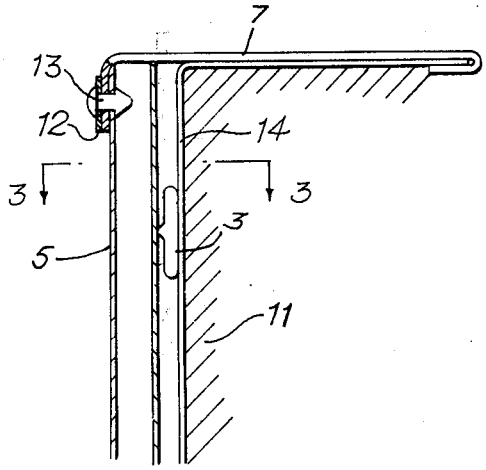
FIG. 4 is an enlarged view of the arrangement as shown in FIG. 2*a* and shows in greater detail the flexible upper retaining strip means.

FIG. 4 shows a detail of the assembly as shown in FIG. 2*a* in which is shown in enlarged form the flexible upper retaining strip means 7 this being attached to the several panels by means of a continuous band 12 and rivets 13 and having one edge bent around the holder member 14 by means of which the assembly may be pressed against the finish wall 11 of the swimming pool. Through the use of this particular assembly arrangement it has been determined that a swimmer can establish contact with his back in striking the touch pad at an angle of up to 60°. In older constructions this arrangement was not possible.

In view of these foregoing arrangements it will be readily appreciated that the completed touch pad may be made more or less flexible by virtue of placing closer together or further apart the individual panels going to make up the completed touch pad. It will be, furthermore, readily evident that each panel may rotate slightly thus making possible a better sensitivity to touch. Finally, it will be clearly evident that the plastic extruded arrangements give rise to a very much lighter construction than in prior known arrangements.

What we claim is:

1. A touch pad for swimming competitions adapted to be mounted on the finishing wall of a swimming pool, comprising:

a striker plate comprising a plurality of elongated hollow vertically extending panels, each panel having along one longitudinal edge a hook portion and along the other longitudinal edge an opening for loosely receiving and interlocking the hook portion of an adjacent panel, while permitting limited free movement of each panel independently of its adjacent panels in a direction transverse to the length of said longitudinal edge; and, at least one elongated cable-like electrical contact switch extending transverse to said panels and positioned between said panels and said finishing wall whereby said contact switch may be closed by pressing any of said panels toward said finishing wall.

2. A touch pad as claimed in claim 1 wherein said panels each include at least one interior reinforcing wall extending across the thickness thereof.

3. A touch pad as claimed in claim 1 wherein said panels are formed of extruded plastic material.

4. A touch pad as claimed in claim 1 and further comprising a further elongated cable-like electrical contact switch extending transverse to said panels and positioned between said panels and said finishing wall.

* * * * *